US007467912B2

(12) United States Patent
Murray

(10) Patent No.: US 7,467,912 B2
(45) Date of Patent: Dec. 23, 2008

(54) EXTENDABLE DRAFT PLATFORM WITH BUOYANCY COLUMN STRAKES

(75) Inventor: John Murray, Houston, TX (US)

(73) Assignee: Technip France, Courbevoie (FR)

( * ) Notice: Subject to any disclaimer, the term of this patent is extended or adjusted under 35 U.S.C. 154(b) by 85 days.

(21) Appl. No.: 11/238,178

(22) Filed: Sep. 28, 2005

(65) Prior Publication Data

US 2006/0067793 A1 Mar. 30, 2006

Related U.S. Application Data

(60) Provisional application No. 60/614,873, filed on Sep. 30, 2004.

(51) Int. Cl.
*B63B 35/44* (2006.01)
*E02B 17/08* (2006.01)

(52) U.S. Cl. ..... 405/211; 405/203

(58) Field of Classification Search ..... 405/203, 405/205, 196, 200, 211, 212, 216
See application file for complete search history.

(56) References Cited

U.S. PATENT DOCUMENTS 6,024,040 A 2/2000 Thomas
6,148,751 A 11/2000 Brown et al.
6,244,785 B1 6/2001 Richter et al.
6,349,664 B1 2/2002 Brown et al.
6,718,901 B1 4/2004 Abbott et al.
6,817,309 B2 11/2004 Horton
6,953,308 B1 10/2005 Horton
2001/0000718 A1 * 5/2001 Blevins et al. ..... 405/205
2005/0084336 A1 * 4/2005 Xu et al. ..... 405/205

* cited by examiner

*Primary Examiner*—Sunil Singh
(74) *Attorney, Agent, or Firm*—Klein, O'Neill & Singh, LLP

(57) ABSTRACT

In an Extendable Draft Platform including a deck, a plurality of buoyancy columns installed in column wells in the deck for movement from a raised position to a submerged position, and a heave plate on the bottom of the columns, each of the columns has an upper portion and a lower portion. A helical strake having a radial height H is fixed to the lower portion of each column. The maximum width of the lower column portion is less than the maximum width of the upper column portion by at least 2H, so that the strake can pass through a column well having maximum width that is only slightly greater than that of the upper column portion. A plurality of guide rails is fixed to the lower portion of each column, each extending along the outer periphery of the strake from the upper column portion to the heave plate.

20 Claims, 3 Drawing Sheets

EXTENDABLE DRAFT PLATFORM WITH BUOYANCY COLUMN STRAKES

CROSS-REFERENCE TO RELATED APPLICATION

This application claims the benefit, under 35 U.S.C. §119 (e), of provisional application No. 60/614,873; filed Sep. 30, 2004, the disclosure of which is incorporated herein by reference.

FEDERALLY SPONSORED RESEARCH OR DEVELOPMENT

Not Applicable

BACKGROUND OF THE INVENTION

This invention relates to the field of deep-draft semi-submersible offshore platforms for the drilling of oil wells and natural gas wells and the production of oil and or gas from such wells. Specifically, the present invention relates to a type of deep-draft semi-submersible platform known as an Extendable Draft Platform, or "EDP." More particularly, the present invention relates to an EDP with improved buoyancy columns that provide increased resistance to vortex-induced vibration (VIV).

One type of offshore platform that has met with commercial success in deep water applications is the semi-submersible platform. Conventional semi-submersible platforms, however, are subject to motions that make it difficult, or even impossible, to support the various types of risers that are employed in such platforms. Deep draft semi-submersible platforms have been proposed that would exhibit superior motion characteristics. One type of deep draft semi-submersible platform is known as the Extendable Draft Platform, or "EDP." The typical EDP comprises a buoyant equipment deck having a plurality of openings ("column wells") through the deck. The deck may conveniently be rectangular or triangular, with a column well at each comer or apex, although other configurations may be used. Installed in each of the column wells is a buoyancy column that can be ballasted (e.g., with seawater). The columns are initially installed in a raised position, and then lowered to a submerged position when the EDP has been moved to a deep water site. Each column is divided by transverse internal bulkheads and horizontal flats (decks) into a plurality of compartments, the compartments including means for introducing water into them for ballasting purposes when the columns are lowered to their submerged positions under a controlled procedure. Attached to the bottom of the columns is a heave plate assembly that helps to stabilize the EDP against the heave response of waves and swells. Examples of prior art EDPs are disclosed in U.S. Pat. No. 6,718,901-Abbott et al. and U.S. Pat. No. 6,024,040-Thomas, the disclosures of which are incorporated herein by reference.

In many regions intended for deployment of EDPs, strong sub-surface currents can cause vortex-induced vibration (VIV) to submerged structures, particularly elongate columns and the like. Prolonged exposure to VIV can result in structural failure due to fatigue damage to the components that are subject to the stresses caused by these motions. It is known that the provision of apparatus on elongated submerged hull structures for vortex breaking, or controlled vortex-shedding, can reduce or eliminate this problem. For example, in U.S. Pat. No. 6,148,751 and U.S. Pat. No. 6,349,664, there is described a hydrodynamic system for reducing vibration and drag on an elongated submerged hull. U.S. Pat. No. 6,244,785 describes elongated helical "strakes" disposed on a pre-cast concrete spar hull. U.S. Pat. No. 6,817,309, the disclosure of which is incorporated herein by reference, describes a spar-type offshore platform that employs helical strakes on submerged tubular cells that form a hull extending downwardly from the deck.

Heretofore, no practical way has been found to address the suppression of VIV in extendable draft platforms. While it would seem that adding strakes to the buoyancy columns of the EDP would be a solution, there are practical problems with this approach. For example, adding strakes to the buoyancy columns would increase the diameter of the columns, thereby increasing the diameter of the column wells through the deck needed to accommodate the columns. This would, in turn, create such problems as reducing the usable area of the deck. Alternatively, the overall diameter of the columns, including the strakes, can be maintained the same as the columns without the strakes. In other words, the tubular body of the column can be reduced by an amount equal to the width of the strakes. This approach, however, would reduce the effective water plane area of the columns, thereby degrading the overall stability of the EDP. Furthermore, there would be a need to protect the strakes from damage as the columns are lowered to their submerged positions through the column wells of the deck. Furthermore, there has been no practical way to fit the strakes onto the columns until after the columns are ballasted down. Thus, installation of the strakes would need to be performed as an underwater construction activity after the column lowering operation, thereby incurring substantial added costs. These considerations have left the EDP with no practical solution to the VIV problem.

SUMMARY OF THE INVENTION

Broadly, the present invention is an improved EDP, of the type including a deck and a plurality of buoyancy columns that are installed in column wells in the deck for vertical movement within the column wells from a raised position to a submerged position, wherein the improvement is characterized in that each of the columns comprises an upper portion having a first diameter or width, a lower portion, and a helical strake of a defined radial height attached to the exterior of the lower portion, wherein the lower portion of the column has a second diameter or width that is less than the first diameter or width by an amount that is approximately equal to twice the radial height of the strake. The improvement further comprises a guard rail on the external edge or outer periphery of the strake to protect the strake as the column moves vertically in the column well.

As will be better appreciated from the detailed description that follows, the present invention offers a practical way to provide EDP columns with the VIV-reducing function of a strake, without the attendant problems that have heretofore discouraged the fitting of strakes onto EDP columns, as discussed above. Moreover, as will also be appreciated, the fitting of the strake only on a lower, reduced-diameter portion of the column allows the strake to be installed on the column before the column is lowered through the column well, thereby avoiding the costs of underwater installation operation. These and other advantages of the present invention will be readily understood from the detailed description that follows.

DETAILED DESCRIPTION OF THE INVENTION

Figure 1:
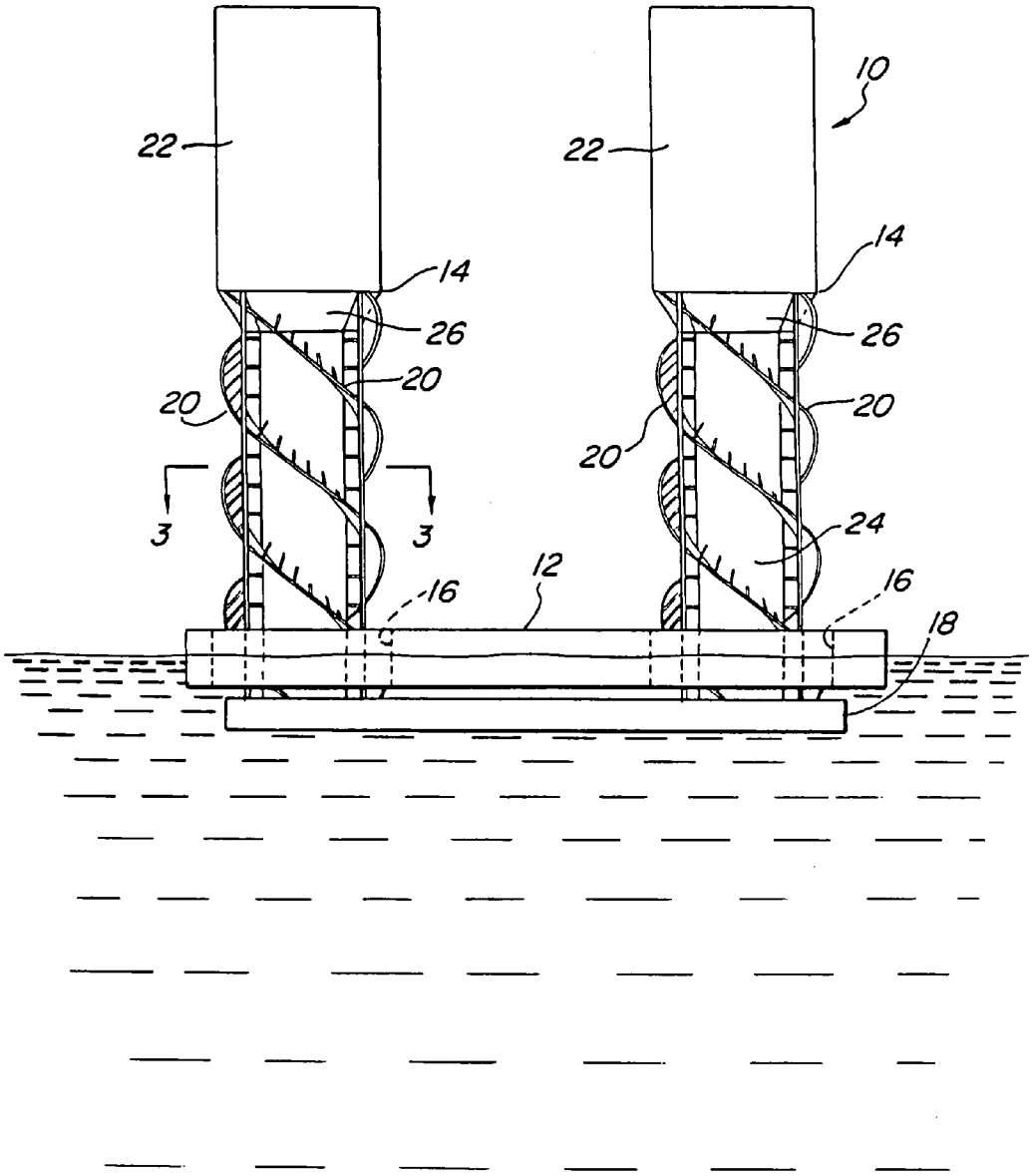
FIG. 1 is a simplified elevational view of an improved EDP in accordance with a preferred embodiment of the present invention, showing the buoyancy columns in the raised position.
Figure 2:
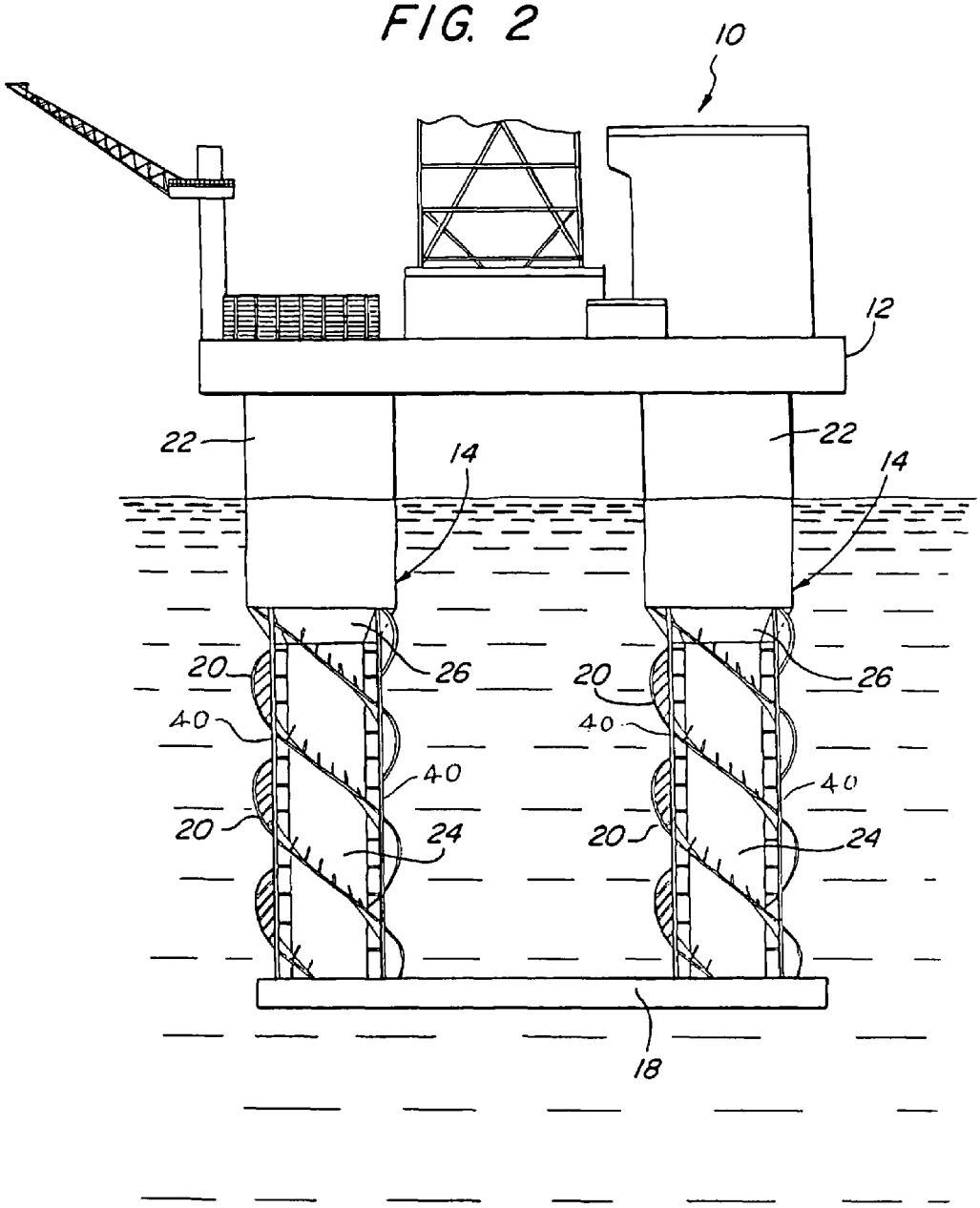
FIG. 2 is a view similar to that of FIG. 1, showing the columns in their lowered or submerged position.

Turning now to the drawings, an EDP 10, in accordance with a preferred embodiment of the invention, includes a buoyant deck 12 and a plurality of buoyancy columns 14 that are mounted for vertical movement through column wells 16 in the deck, from a raised position (FIG. 1) to a lower or submerged position (FIG. 2). The bottom ends of the columns 14 are advantageously attached to a heave plate 18.

Although two columns 14 and column wells 16 are shown, it is understood that, depending on the size and the configuration of the deck 12, there may be three, four, or even more columns 14 and associated column wells 16. The cross-sectional configuration of the columns 14 may be circular, triangular, square, or polygonal, with a corresponding shape for the column wells 16. For the sake of simplicity, the cross-sectional dimension of the columns 14 and column wells 16 will be referred to in this description as the "diameter," but, in the case of a non-circular cross-section, it should be understood that this dimension would more accurately be referred to as the "maximum width."

Each of the columns 14 may be divided into a plurality of buoyancy and ballasting compartments by internal transverse bulkheads (not shown), as is conventionally known in the art, and internal vertical bulkheads (not shown) may also be provided for structural strength, as is also well-known. The mechanisms for ballasting and de-ballasting the internal compartments are conventional and well-known, and need not be described herein.

The columns 14 are maintained in their raised position, as shown in FIG. 1, when the EDP is in shallow water, and during transport to its deep water deployment site. When the EDP reaches its deployment site, the columns 14 are ballasted to lower them to their submerged position, the tops of the columns 14 are secured to the deck 12, and then the columns 14 are de-ballasted to raise the deck 12 above the water level (FIG. 2).

Figure 3:
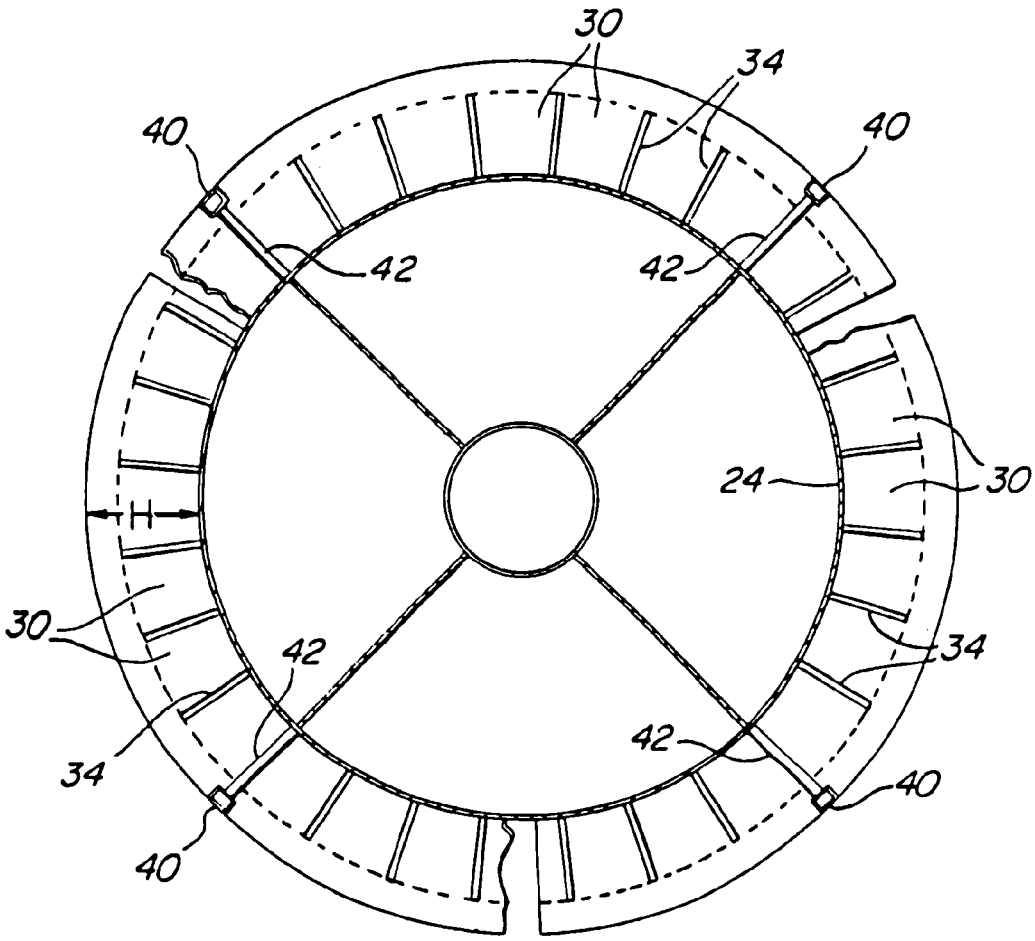
FIG. 3 is a cross-sectional view taken along line 3-3 of FIG. 1

A novel aspect of the present invention is the configuration of the columns 14 so as to accommodate at least one helical strake 20, and preferably three helical strakes 20. Specifically, each of the columns 14 has a relatively large diameter upper portion 22 and a smaller diameter lower portion 24, joined by a tapered transitional section 26. The strakes 20 are attached to the lower column portion 24, and each extends radically from the lower column portion by a radial distance or height H (FIG. 3). The diameter of the lower column portion 24 is less than the diameter of the upper portion 22 by at least approximately twice the radial height H of the strake 20. Thus, the combined diameter of the lower portion 24 and the strake or strakes 20 is approximately equal to the diameter of the upper portion 22. With this configuration, the column 14 provides the benefit of the relatively large water plane area of the upper portion 22, while the strake or strakes 20 can pass through a column well whose diameter is no greater than that of the upper portion 22.

The strake or strakes 20 may be constructed as disclosed in the above-mentioned U.S. Pat. No. 6,817,309. Briefly, each strake 20 comprises a series of flat panels or plates 30 that are reinforced at their outer edges by a longitudinal structural member 32. The panels are connected together at their adjacent ends and supported thereat by stanchions 34, which are affixed to the exterior surface of the lower portion 24 of each column 14. The lowermost end of the longitudinal member 32 provides a foundation for attaching the panels 30 to the column 14 along a spiral path. The panels 30 thus conform closely to the curvature of the column, thereby blocking the flow of water at the base of the strakes. In one possible embodiment, the outer edges of the panels 30 may extend beyond the longitudinal reinforcing member 32, thereby providing a relatively sharp edge on the strake, which enhances the performances of the strake by breaking up eddies as seawater passes over the top of the strake.

Other strake constructions and configurations may suggest themselves to those skilled in the pertinent arts. One such alternative strake construction is disclosed in co-pending, commonly assigned application Ser. No. 10/844,264, filed May 12, 2004, the disclosure of which is incorporated herein by reference.

Another novel aspect of the invention is the provision of a plurality of longitudinal guide rails 40 extending from an upper end fixed to the bottom of the upper column portion 22 (preferably at or near the juncture between the upper column portion 22 and the transitional column portion 26), and a lower end fixed to the heave plate 18. As best shown in FIG. 3, the guide rails 40 (preferably four in number, at 90° intervals), extend along the outer periphery of the strakes 20, and are attached to the exterior of the lower column portion 24 by radial support elements 42, which may be configured as rods or posts. The guide rails 40 offer protection for the strakes 20 as the columns descend through the column wells.

Although a preferred embodiment of the invention has been described herein, it will be appreciated that a number of variations modifications may suggest themselves to those skilled in the pertinent arts. For example, as mentioned above, the present invention may be adaptable for use with any number of particular strake configurations without departing from the contemplated scope of the invention. Also, the buoyancy columns may be made without a transitional portion, the reduced width or diameter lower portion being directly joined to the larger width or diameter upper portion. In that latter configuration, the upper ends of the guide rails would be fixed to the bottom of the upper column portion. These and other variations and modifications are considered to be within the spirit and scope of the present invention, as defined in the claims that follow.

What is claimed is:

1. An Extendable Draft Platform (EDP), of the type including a deck and a plurality of buoyancy columns installed in column wells in the deck for vertical movement from a raised position to a submerged position, wherein each of the columns comprises:

an upper portion having a first maximum width;

a lower portion having a second maximum width; and a helical strake on the lower portion, the helical strake having a radial height H, wherein the second maximum width is less than the first maximum width by at least 2H.

2. The EDP of claim 1, wherein the second maximum width is less than the first width by approximately 2H.

3. The EDP of claim 1, wherein the upper and lower column portions are substantially cylindrical, wherein the first maximum width is a first maximum diameter, and wherein the second maximum width is a second maximum diameter.

4. The EDP of claim 1, wherein each of the columns includes a transitional portion between the upper portion and the lower portion, the transitional portion having a width that varies from the first maximum width at a first juncture with the upper column portion to the second maximum width at a second juncture with the lower column portion.

5. The EDP of claim 4, wherein the strake has an outer periphery, and wherein each of the columns further comprises a plurality of longitudinal guide rails on the lower column portion, each of the guide rails extending downwardly along the outer periphery of the strake from the first juncture.

6. The EDP of claim 5, wherein each of the columns has a bottom end fixed to a heave plate, and wherein each of the guide rails has a lower end fixed to the heave plate.

7. The EDP of claim 1, wherein the strake has an outer periphery, and wherein each of the columns further comprises a plurality of longitudinal guide rails fixed to the lower column portion, each of the guide rails extending downwardly along the outer periphery of the strake from the upper column portion.

8. The EDP of claim 7, wherein each of the columns has a bottom end fixed to a heave plate, and wherein each of the guide rails has a lower end fixed to the heave plate.

9. The EDP of claim 7, wherein each of the guide rails is attached to the lower column portion by a plurality of radial support elements.

10. The EDP of claim 7, wherein each column comprises four guide rails fixed to the lower column portion, the guide rails being located at 90° intervals.

11. An Extendable Draft Platform (EDP), of the type including a deck and a plurality of buoyancy columns installed in column wells in the deck for vertical movement from a raised position to a submerged position, wherein each of the columns has a bottom end fixed to a heave plate, characterized in that each of the columns comprises:

an upper portion having a first maximum width;

a lower portion having a second maximum width;

a helical strake on the lower portion, the helical strake having an outer periphery and a radial height H, wherein the second maximum width is less than the first maximum width by at least 2H; and a plurality of longitudinal guide rails fixed to the lower column portion, each of the guide rails extending downwardly along the outer periphery of the strake from the upper column portion to the heave plate.

12. The EDP of claim 11, wherein each of the columns is further characterized by a transitional portion between the upper portion and the lower portion, the transitional portion having a width that varies from the first maximum width at a first juncture with the upper column portion to the second maximum width at a second juncture with the lower column portion.

13. The EDP of claim 12, wherein each of the guide rails extends downwardly from the first juncture to the heave plate.

14. The EDP of claim 11, wherein each of the guide rails is attached to the column lower portion by a plurality of radial support elements.

15. The EDP of claim 11, wherein the second maximum width is less than the first width by approximately 2H.

16. The EDP of claim 11, wherein the upper and lower column portions are substantially cylindrical, wherein the first maximum width is a first maximum diameter, and wherein the second maximum width is a second maximum diameter.

17. An Extendable Draft Platform (EDP), comprising:

a deck including a plurality of column wells;

a buoyancy column installed in each of the column wells for vertical movement from a raised position to a submerged position, wherein each of the columns has an upper portion having a first maximum width, a lower portion having a second maximum width, and a bottom end;

a heave plate fixed to the bottom ends of the columns;

a helical strake on the lower portion, the helical strake having an outer periphery and a radial height H; and a plurality of longitudinal guide rails fixed to the lower portion of each column by a plurality of radial support elements, each of the guide rails extending downwardly along the outer periphery of the strake from the upper portion of the column to the heave plate;

wherein the second maximum width is less than the first maximum width by at least 2H.

18. The EDP of claim 17, wherein each of the columns further comprises a transitional portion between the upper portion and the lower portion, the transitional portion having a width that varies from the first maximum width at a first juncture with the upper column portion to the second maximum width at a second juncture with the lower column portion.

19. The EDP of claim 18, wherein each of the guide rails extends downwardly from the first juncture to the heave plate.

20. The EDP of claim 17, wherein the upper and lower column portions are substantially cylindrical, wherein the first maximum width is a first maximum diameter, and wherein the second maximum width is a second maximum diameter.

* * * * *